United States Patent [19]

Morgan

[11] 4,175,250

[45] Nov. 20, 1979

[54] TRANSISTOR BIAS CIRCUIT

[75] Inventor: Denny E. Morgan, Thousand Oaks, Calif.

[73] Assignee: Bunker Ramo Corporation, Oak Brook, Ill.

[21] Appl. No.: 892,100

[22] Filed: Mar. 31, 1978

[51] Int. Cl.[2] ..... G05F 1/56

[52] U.S. Cl. ..... 323/22 T; 323/22 R

[58] Field of Search ..... 307/296, 297; 323/4, 323/19, 22 T, 22 R

[56] References Cited

U.S. PATENT DOCUMENTS 4,042,843 8/1977 Sikes ..... 323/22 R

OTHER PUBLICATIONS

Application Note AN-178, "Applications for an Adjustable IC Power Regulator", National Semiconductor Corp., Jan., 1977, 4 pages.

National Semiconductor Linear Data Book, LM117/LM217/LM317, 1976, pp. 1-15, 1-18 through 1-22.

*Primary Examiner*—A. D. Pellinen

*Attorney, Agent, or Firm*—F. M. Arbuckle; A. Freilich

[57] ABSTRACT

A constant bias voltage and current for a transistor is provided by two series resistors connected across the transistor with a voltage regulator connected to a source of DC voltage for maintaining a predetermined voltage across the one resistor connected to the output electrode (drain or collector) of the transistor. The common electrode (source or emitter) is connected to a source of constant current.

5 Claims, 5 Drawing Figures

TRANSISTOR BIAS CIRCUIT

BACKGROUND OF THE INVENTION

This invention relates to a bias circuit for a transistor, and more particularly to a bias circuit for a microwave field-effect transistor.

A field-effect transistor (FET) is more difficult to bias than bipolar transistors. This is particularly true of a gallium arsenide (GaAs) microwave FET because the gate-to-source voltage, $V_{gs}$, is frequently comparable to and sometimes larger than the drain-to-source voltage, $V_{ds}$, whereas most biasing schemes rely upon the latter being much greater than the former.

Biasing of a GaAs FET can be achieved in a conventional manner by selection of resistors, or by potentiometer adjustments, but such conventional biasing has the disadvantage of being temperature sensitive, and often expensive, unreliable, or time consuming to adjust. An object of this invention is to provide a biasing circuit for a FET.

SUMMARY OF THE INVENTION

In exemplary embodiments of the invention, a constant bias voltage and current is provided for a transistor by the combination of two resistors in series between common and output electrodes of the transistor, namely the source and drain electrodes of an FET, and the emitter and collector electrodes of a bipolar transistor, and means connected to a source of direct current voltage for maintaining a predetermined voltage across the one resistor connected to the output electrode, thereby to produce a constant current through that one resistor. The common electrode of the transistor is connected to the source of constant current by a means selected for maintaining the desired bias current through the transistor. A signal to be amplified is applied to a third (control) electrode of the transistor.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
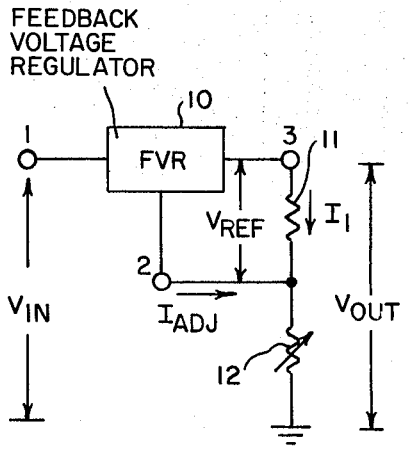
FIG. 1 PRIOR ART
FIG. 1 illustrates a conventional circuit utilizing a feedback voltage regulator to maintain a constant voltage across one resistor thereby to produce a constant current through a second series resistor, thereby to produce a regulated voltage across the two series resistors.

Referring now to FIG. 1, a 3-terminal feedback voltage regulator 10 is shown with an input terminal 1 adapted to be connected to a source of direct current voltage, and its control and output terminals, 2 and 3 respectively, connected to ends of a resistor 11. The regulator thus connected is floating in that it maintains a constant voltage, $V_{REF}$, across the resistor 11. As a consequence, a constant current, $I_1$, is maintained from the output terminal through a second resistor, or potentiometer, 12 to maintain a substantially constant output voltage, $V_{OUT}$. The adjustment current $I_{ADJ}$ from terminal 2 is negligible so that it will not affect the output voltage $V_{OUT}$ or constant current $I_1$. The output voltage is given by $$V_{OUT} = V_{REF}\left(1 + \frac{R12}{R11}\right) + I_{ADJ}(R12)$$

National Semiconductor Corporation produces such a feedback voltage regulator (FVR) as a 3-terminal adjustable regulator LM117 capable of supplying in excess of 1.5 amperes over an output voltage range from 1.2 V to 37 V. However, any 3-terminal feedback regulator with negligible feedback control current $I_{ADJ}$ would be acceptable for the present invention.

Figure 2:
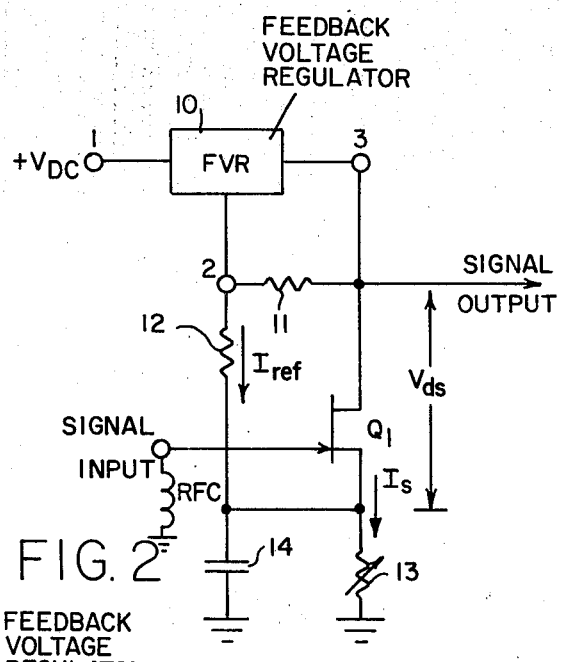
FIG. 2 illustrates the novel application of the circuit of FIG. 1 to bias an FET.

The voltage regulation circuit of FIG. 1 is employed in a novel manner to provide bias (voltage and current) for a field-effect transistor $Q_1$ in a circuit as shown in FIG. 2. For convenience in understanding this bias arrangement, the same reference numerals are employed for elements in this bias arrangement common to the circuit of FIG. 1. Additional elements are a small resistor, or potentiometer 13 and a capacitor 14. The resistor 13 is chosen, or set, for the desired bias current. The object of the bias arrangement is to provide a constant drain-to-source bias voltage, $V_{ds}$, and current, $I_s$. The drain-to-source bias voltage is thus given by the following equation (neglecting $I_{ADJ}$):

$$V_{ds}=(V_{REF}/R_{12})[R_{12}+R_{11}]$$

The bias current $I_s$, i.e., the current through the source electrode of the field-effect transistor, is given by the equation $$I_s=I_c-I_{REF}$$

where $I_c$ is the constant current of the resistor 13. The capacitor 14 is to provide an rf ground and frequency compensation of the FVR. The value of resistor 13 depends upon the characteristics of $Q_1$ and upon the current through resistor 12. Accordingly, resistors 12 and 11 are made large compared to 13 so that 13 and $Q_1$ more precisely fix the current through $Q_1$. A transistor biased in this manner will amplify an input signal and provide an output signal which may be DC coupled to another amplifying stage, as described with reference to FIG. 5. The signal input terminal is preferably connected to ground through an RF choke, as represented in FIG. 2.

Figure 3:
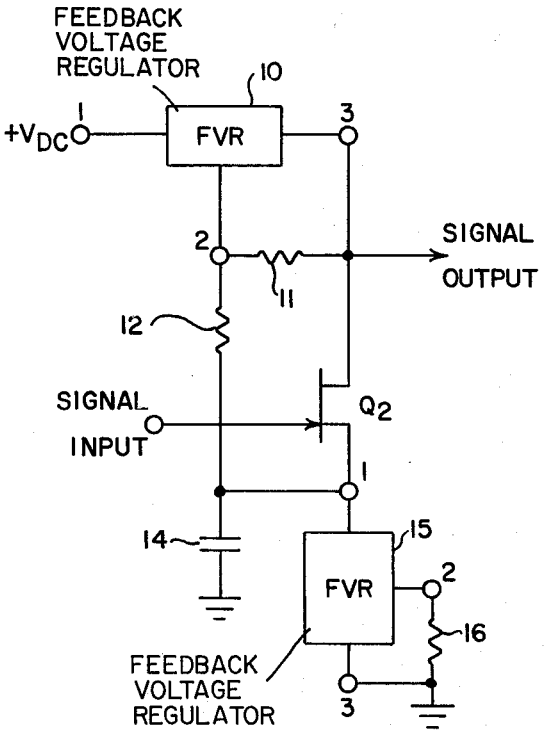
FIG. 3 illustrates a variation of the bias circuit of FIG. 2.

FIG. 3 illustrates a second embodiment, or variant, of a circuit for biasing a field-effect transistor $Q_2$. Elements common to the embodiment of FIG. 2 are identified by the same reference numerals. The variation is the use of a feedback voltage regulator 15 with a feedback resistor 16 to provide a constant current.

Figure 4:
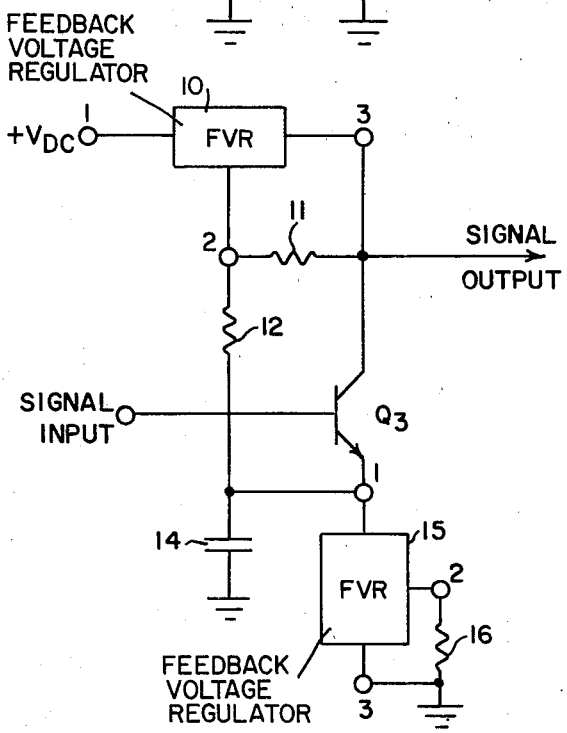
FIG. 4 illustrates the novel application of the circuit of FIG. 3 to bias a bipolar transistor.

FIG. 4 illustrates the application of this biasing circuit to a bipolar transistor $Q_3$. For convenience, the same reference numerals are used as for the biasing circuit in FIG. 3 from which it can be seen that the same circuit can be applied to a bipolar transistor as well as to a FET. The same applies to the biasing circuit of FIG. 2 which differs only in the implementation of the constant current source.

Figure 5:
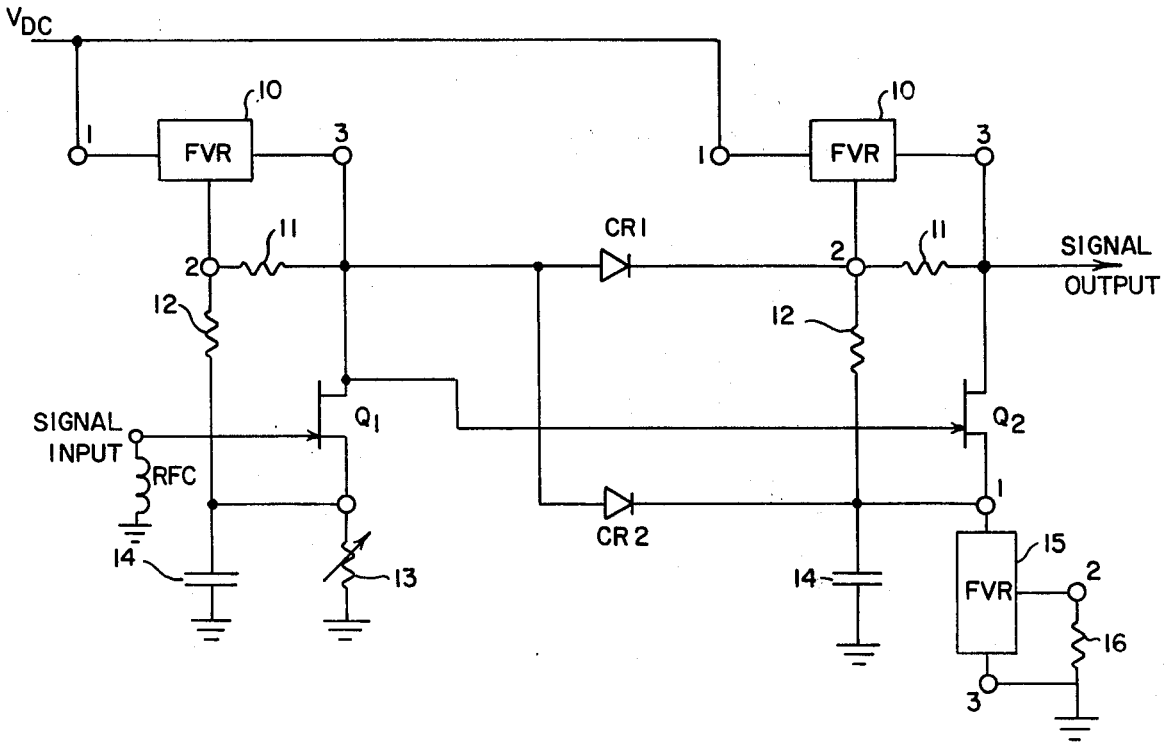
FIG. 5 illustrates of two FETs in cascade with the bias circuits of FIGS. 1 and 2.

Referring now to FIG. 5, transistors $Q_1$ and $Q_2$ of FIGS. 2 and 3 are shown, with their biasing circuits, connected in cascade. This illustrates one advantage of the present invention, which is that the two transistors may be directly coupled, i.e., connected with a DC coupling. Diodes $CR_1$ and $CR_2$ protect the gate electrode of the transistor $Q_2$ against forward bias if accidental shorting to ground occurs. Such an accidental shorting may occur while tuning if these cascaded amplifiers are used in a microwave system with GaAs microwave FETS. An alternative might be the use of a Zener diode in place of the diode $CR_2$, and another alternative might be the use of a Zener diode from the gate to the source of the transistor $Q_1$ to protect against occurence of shorts and oscillations during tuning. Any of the resistors could be placed in series or parallel with a temperature sensitive element (or replaced by a temperature sensitive element) to achieve a specific type of temperature compensation. The amplifier circuit requires only a single unregulated supply. It is explicity designed for a direct coupled stage of amplification. Additional similar amplifier stages could easily be added by direct coupling. For some applications, the transistors could be bipolar transistors.

Although particular embodiments of the invention have been described and illustrated herein, it is recognized that modifications and variations may readily occur to those skilled in the art. For example, the embodiments disclosed herein have assumed a common source electrode configuration. However, it should be readily understood that the invention is also applicable to common drain of common gate configurations and it is therefore intended that the claims be interpreted to cover such modifications and variations.

The embodiments of the invention in which an exclusive property or privilege is claimed are described as follows:

1. A circuit for providing a constant bias voltage and current for a transistor having a common electrode, an output electrode, and a control electrode adapted to receive a signal input, said circuit comprising a source of direct current voltage, two resistors in series between said common electrode and output electrode of said transistor, a first series resistor connected to said output electrode and a second series resistor connected to said common electrode of said transistor, voltage regulating means connected to said source of direct current voltage for maintaining a predetermined voltage across said first resistor of said two resistors connected in series to the output electrode, thereby to produce a first constant current through said first resistor, and means for providing a second constant current connected to said common electrode of said transistor, thereby to maintain a desired bias current through said transistor that is equal to the difference between said first and second constant currents while maintaining a constant bias voltage across the transistor from the output electrode to the common electrode.

2. A circuit as defined in claim 1 wherein said transistor is a field-effect transistor and said common output and control electrodes are the source, drain and gate electrodes, respectively, of said field-effect transistor.

3. A circuit as defined in claim 1 wherein said transistor is a bipolar transistor and said common output and control electrodes are the emitter, collector and base electrodes, respectively, of said bipolar transistor.

4. A circuit as defined in claim 1 wherein said voltage regulating means is a 3-terminal feedback voltage regulator having an input terminal connected to said source of direct current voltage, an output terminal connected to said output terminal of said transistor and a control terminal, said control terminal being connected to the regulator output terminal by said first resistor.

5. A circuit as defined in claim 1 connected in cascade with a like circuit by connecting the output terminal of the transistor in one to the control terminal of the transistor in the other.

* * * * *